United States Patent [19]

Schwarz

[11] 4,154,268

[45] May 15, 1979

[54] READING DEVICE, IN PARTICULAR FOR A SHED-FORMING MACHINE

[75] Inventor: Rudolf Schwarz, Horgen-Zurich, Switzerland

[73] Assignee: Staeubli, Ltd., Horgen-Zurich, Switzerland

[21] Appl. No.: 762,732

[22] Filed: Jan. 26, 1977

[30] Foreign Application Priority Data

Jan. 30, 1976 [CH] Switzerland ..... 1206/76

[51] Int. Cl.[2] ..... D03C 1/00

[52] U.S. Cl. ..... 139/68; 139/331

[58] Field of Search ..... 139/59, 68, 331; 66/50 R, 75

[56] References Cited

U.S. PATENT DOCUMENTS

| | | | |
|---|---|---|---|
| 748,028 | 12/1903 | Szczepanik | 139/331 |
| 2,085,459 | 6/1937 | Wiget | 139/331 |
| 3,665,972 | 5/1972 | Hoenig | 139/68 |

FOREIGN PATENT DOCUMENTS

| | | | |
|---|---|---|---|
| 614839 | 1961 | Italy | 139/331 |
| 636199 | 3/1962 | Italy | 139/331 |

*Primary Examiner*—Henry Jaudon

*Attorney, Agent, or Firm*—Blanchard, Flynn, Thiel, Boutell & Tanis

[57] ABSTRACT

A method for controlling the heddle movement in a shed-forming machine and apparatus for performing the method. Reading needles are moved into and out of engagement with a pattern card having perforated and nonperforated portions therein actively cooperating with the needles which are adapted to move toward and away therefrom. Power amplifying structure is provided for converting the control operations noted by the reading needles into mechanical movements effecting selected control of the heddles dependent upon the position of the reading needle relative to the pattern card. A lock member is movably supported on a bar and its movement is controlled by whether the reading needle is received into a perforated portion of the pattern card or whether it engages a nonperforated portion of the pattern card. A shifting of the locking member will result in a selected and simultaneous control of a correcting element to either lift a draw hook or lower same into and out of engagement with a draw knife.

12 Claims, 26 Drawing Figures

3
II
4
28
1
11
29
27
13
16
14
9
10
15
17
19
900
900
18
9
10
5
8
7
2
6
II

I
3
4
11
27
28
9
16
10
14
900
18
17
19
9
5
24
8
25
26
6
7
I

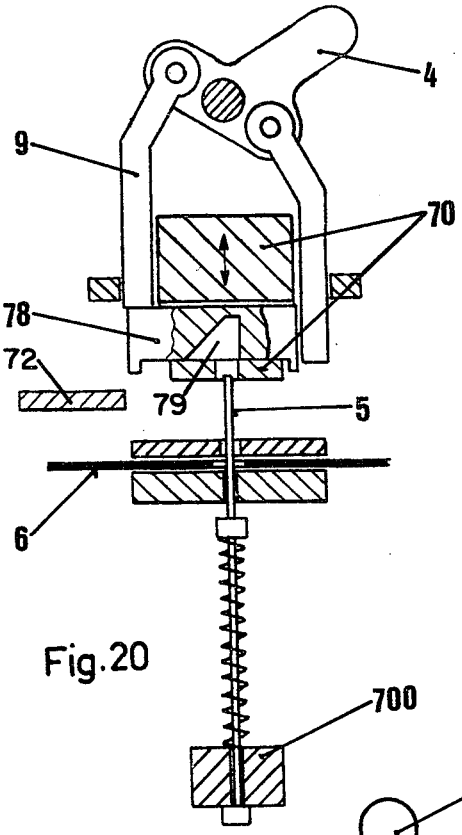
Fig.20
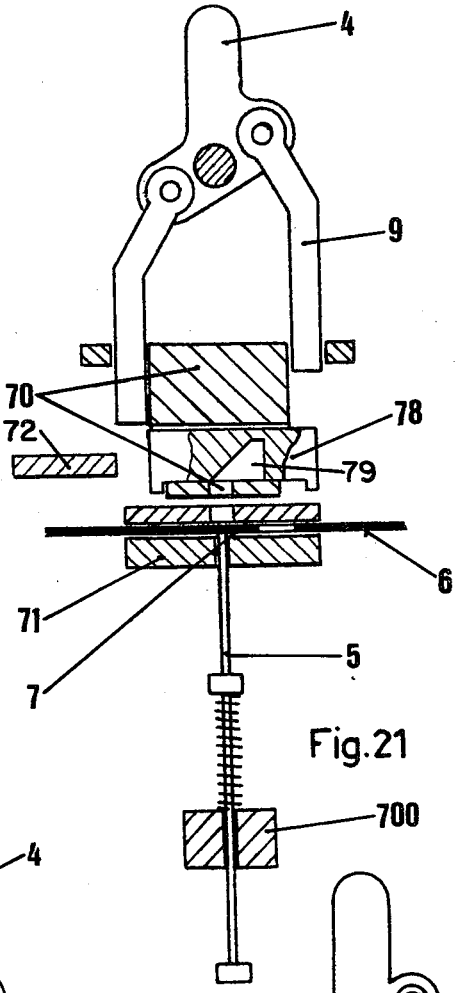
Fig.21
Fig 22
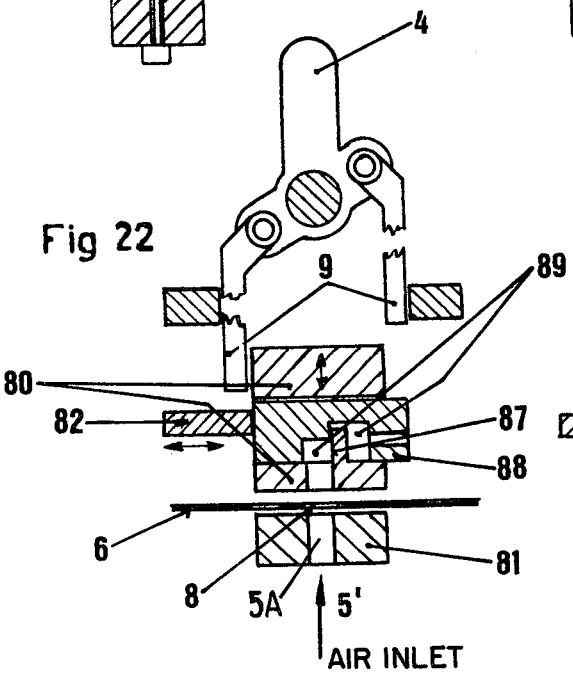
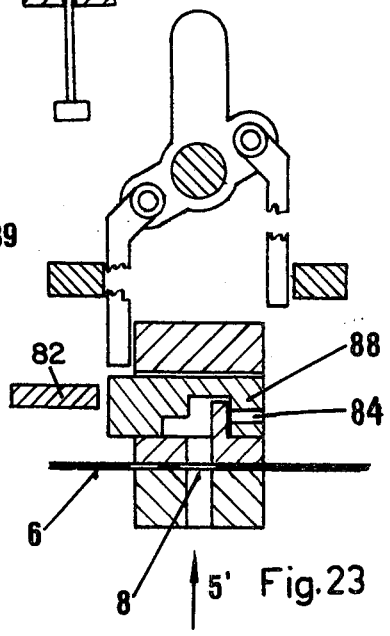
Fig.23

READING DEVICE, IN PARTICULAR FOR A SHED-FORMING MACHINE

FIELD OF THE INVENTION

The invention relates to a method for operating the reading and control device of a shed-forming machine with a reading needle which reads a patternlike perforated, foillike pattern card and has a power amplifier which acts in direction of the movement of the needle, from which power amplifier a sinker, a draw hook or a switching member of the shed-forming machine is controlled.

BACKGROUND OF THE INVENTION

In the case of shed-forming machines in weaving machine construction, in which a pattern card, which has holes and nonperforated parts as control places thereon, is read, the reading needles move periodically toward the pattern card wherein the one of two read results is transmitted automatically as a control impulse through intermediate needles or levers and included a first power amplifier to the element for the second and possible third and last power amplification, namely a draw hook, switching wedge etc., after which this draw hook or wedge lifts, lowers or leaves motionless and in a pattern the heddle. Between two control periods, it is necessary that the members, for example reading needles and intermediate needles, are withdrawn from the influence or control by the pattern card before the first power amplification so that the pattern card can be indexed for the next control operation. During this period, the control of the draw hooks controlled by the first and further power amplifiers must be maintained unchanged in the known devices. However, this fixed control position must be cancelled at the start of the next control period so that the participating members can be programmed again for the next weft. In this returning or restoring of the control members, partly forces of gravitation and partly those of pretensioned springs act as the driving force. Such control systems have several power amplifiers, controlled locking devices for fixing the controlled picture and utilize a considerable time interval during the transmission of an impulse and have complicated sequences of movement which are supported by the force of the gravitation or a pretensioned spring, operate unreliably at higher rotational speeds, which leads to binding errors.

It has been tried to leave out, in such control units, amplifying stages, to operate interengaging sequences of movement with shorter intervals and to reinforce springs. The rotational speed was thereby able to be increased slightly, but the device, which has become sensitive, continued to cause binding errors.

Therefore the object became to build a control system for a shed-forming machine wherein, in the case of higher rotational speeds or short shed, standstill and improved and errorfree operation is assured as well as an increase in production.

This object is achieved with a reading device mentioned hereinabove, in which the reading needle is supported at least in a portion of the power amplifier and is moved with same together or in partial sequence, wherein during reading of a nonperforated part the needle moves relative to the power amplifier, and wherein a lock member is supported in the power amplifier, which lock member is moved into a position transversely with respect to the direction of movement of the power amplifier by the reading needle depending on the read pattern part in such a manner that it during its movement with the power amplifier simultaneously controls a sinker, a draw hook or a switching member of the shed-forming machine.

The inventive device is characterized in such a manner that the reading needle is movably supported in a conventional manner in the power amplifier in a direction of movement toward the pattern card and that it is in positive engagement with a lock member which is movably supported in two positions in the power amplifier in transverse direction to the direction of movement of the reading needle, whereby it is in its two positions each in the path of movement of a control part of a sinker, a draw hook or a switch lever of the control machine, thus the precontrolled lock member and the power amplifier form one unit and also move periodically back and forth as a unit in one draw or in successive draws in direction of the reading movement of the reading needle, wherein at the end of the forward movement, the reading needle has the deepest position in a hole of the card or, in the case of the existence of a nonperforated part, is sunk the deepest in its mounting, while the draw hook or the switching wedge etc. is controlled completely. Forces which come neither from gravity nor from a tensioned spring act on the entire forward movement. The power amplifier moves thereby the lock member automatically regardless of the presence of a hole or a nonperforated part of the pattern card. Furthermore, the lock member transmits during its operating movement released by the power amplifier the control impulse automatically and simultaneously onto a correcting element or the draw hook of a shed-forming machine or the switching wedge of a shed-forming machine having an eccentric ring drive, wherein the correcting element or the switching wedge is blocked at each end of its two controlled positions by a passively acting brake.

The described control unit has a mass and a low friction reading needle and a lock member which is to be precontrolled, which permits a movement of the reading needle with a high speed toward the pattern card, without any danger of damaging the pattern card at the location of a nonperforated part. The precontrolled lock member can control with the same speed and simultaneously therewith the correcting element or the switching wedge, in order to therewith bring the draw hook into engagement with the draw knife or with the locking knife.

As already mentioned, the correcting element or the switching wedge remains in its one-time assumed control position through a brake device or through its special construction. The power amplifying unit can after its forward movement be immediately moved back without influencing the controlled position. The reading needle is thus lifted off, and the pattern card indexed, while the control acts on the movement of the shed-forming machine. From this one recognizes that such a machine can operate quicker and more precise at a simultaneous protection of the pattern card. Due to the fact that during one single control period first the preceding and immediately thereafter the new weft is read, the correct weft-sequence operation of the dobby is assured.

By leaving out the hook or wedge which is to be controlled by the correcting element, the correcting element can control on weaving machines for example the colors, the winding up of material or the heddles for the edge turners or the weaving in of names etc.

BRIEF DESCRIPTION OF THE DRAWINGS

Various exemplary embodiments of the subject matter of the invention are illustrated in the drawings, in which:

FIGS. 19 and 20 are similar to FIG. 18 and during reading of a hole;

FIG. 21 is similar to FIG. 18 but during a reading of a nonperforated part of the pattern card;

FIGS. 22 and 23 illustrate a still further modification in the two control positions similar to FIGS. 18 to 21, wherein the reading needle is replaced by a reading air jet;

DETAILED DESCRIPTION

Figures 1, 2:
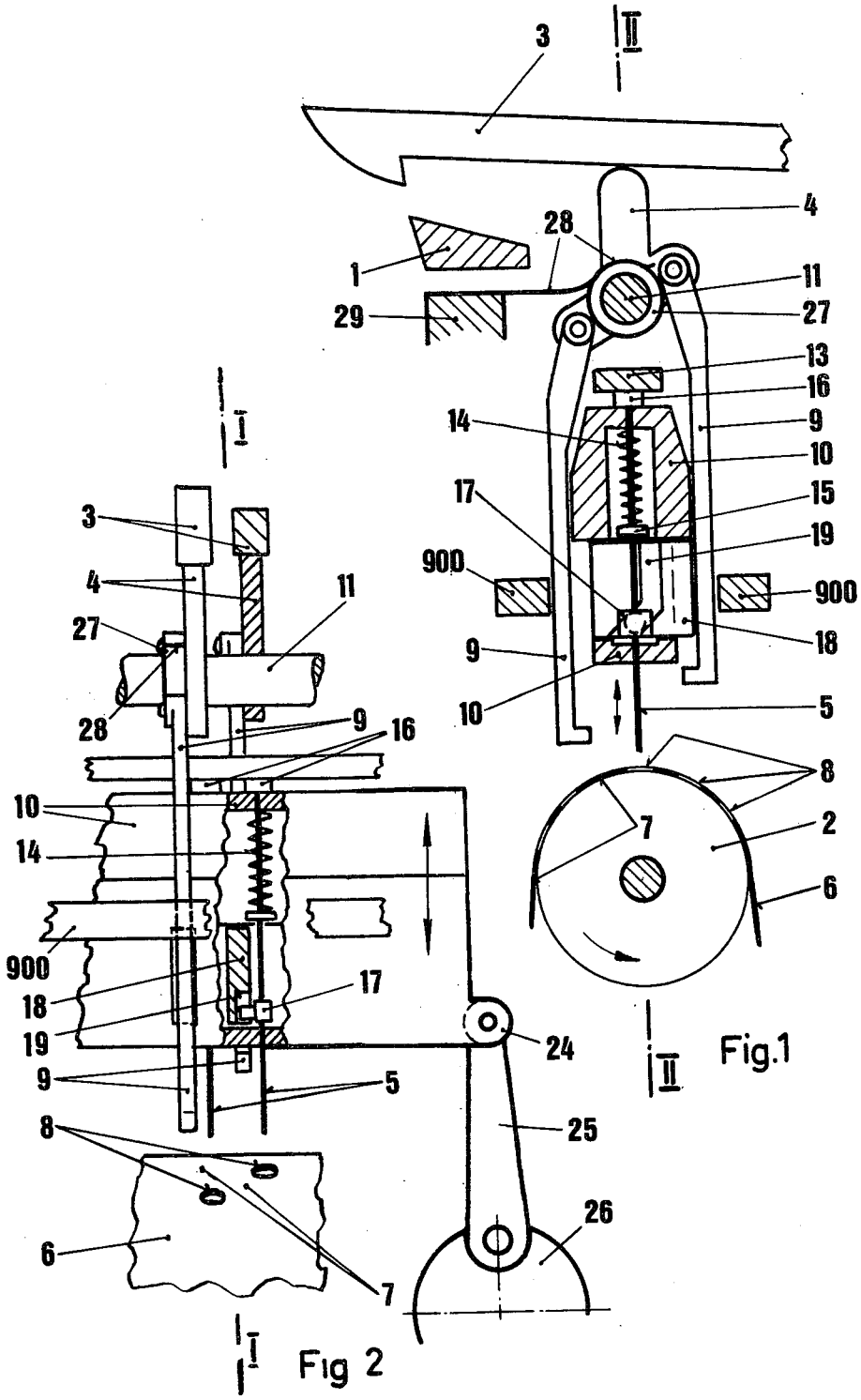
FIG. 1 is a partly schematic, fragmentary sectional view taken along the line I—I of FIG. 2 of a shed-forming device of a Hattersley system having the inventive control device embodied therein, which is arranged between the pattern card and draw hook, in the normal position, namely prior to a reading of the pattern card.
FIG. 2 is a sectional view taken along the line I—I of FIG. 1.

Shed-forming machines are used to move the heddles in weaving machines. With reference to complicated patterns, the shed-forming machines are generally controlled by a pattern card. The mostly used shed-forming machine operates according to the Hattersley principle with one baulk per heddle to the ends of which are hingedly secured draw hooks which are engaged and pulled out by draw knives. The draw hooks are sequentially caught on and removed from the draw knives preferably by reading needle structure cooperating with the pattern cards, which pattern cards consist of a foil having nonperforated parts and holes thereon and functioning as control places which are read by the reading needles.

A different known shed-forming machine has one eccentric ring per heddle which is supported on a drive shaft in the machine and has a wedge, which is radially movable and is controlled by a pattern card such that it engages or does not engage a groove of the drive shaft. Here too, in the case of large patterns, a pattern card with nonperforated places and holes is preferably used. Further types of shed-forming machines or apparatus which exercise a certain control and operating function on the weaving machine are known.

All following exemplary embodiments can be installed in the known machines, however, the following discussion is presented exclusively in connection with a shed-forming machine of the Hattersley system wherein the reading control device (FIG. 1) is installed between a draw hook 3 and a pattern card 6 made of foil material and having nonperforated parts 7 and holes 8 therein.

With reference to the various modified embodiments having the same component parts, the same reference numerals are used. More specifically, disks 2 are rotatably supported on a shaft and form a card cylinder which supports a pattern card 6. The pattern card 6 is read by a reading needle 5. Together all examples have the same draw arms 9 which are supported in the guideways 900, which draw arms 9 hingedly engage a three-arm correcting element 4 through pivot axis defining bolts. The correcting element 4 is pivotally supported on a stationary axis member 11. The draw knife for the draw hooks 3 has the reference numeral 1.

FIGS. 1 and 2 illustrate the moment when, while the reading needle 5 is lifted out of and away from the pattern card 6, the cylinder 2 has indexed the card 6 in the direction of the arrow. A hole is now located beneath the needle, while during the preceding reading operation, a nonperforated place 7 was present. The reading needle 5 is guided slidably in its longitudinal direction in a power-amplifying bar 10 wherein a return spring 14, one end of which is supported on a frame 10A, applies a pressure onto a flange 15 on the needle. The pressure is dimensioned such that the pattern card 6 is not damaged by engagement of the reading needle 5 therewith. A second flange 16 on the needle serves as a movement limiting member for the needle. A guide block 17 is positioned on the reading needle 5 and has a cam follower which is guided into engagement with a lock member 18 and particularly is received in a groove 19 in the lock 18. The lock member 18 is supported for transverse movement on the bar 10 and with respect to the axis of the reading needle 5. The lock member 18 projects, in the normal position according to FIG. 1, outwardly away from the bar 10 on one side. The groove 19 extends first parallel to the needle and then at an angle inclined with respect to the reading needle 5.

The power-amplifying bar 10 is supported in a not shown guideway and carries out a movement toward and away from the pattern card 6.

If the bar 10 is lowered from its position according to FIG. 1 toward the pattern card 6 and the reading needle 5 reads one hole 8, the needle does not change its position relative to the bar 10 under the action of the spring 14 and enters the hole in the pattern card 6. The lock member 18 remains in the same position with respect to the bar. The cam follower 17 is in the sloped part of the groove 19. During its path of movement to the position shown in FIG. 3, the bar 10 engages and carries along therewith the right draw arm 9 over the lower offset portion. The correcting element 4 tilts about its axis 11, through which the support of the draw hook 3 is cancelled. The draw hook 3 is lowered before the draw knife 1.

After the control operation is concluded, the reading device, namely the bar 10, is lifted without influencing the position of the draw hook. The pattern card 6 is indexed to read the next or the preceding weft. This means a considerable savings in time in the operating rhythm of the shed-forming device.

Figures 3, 4:
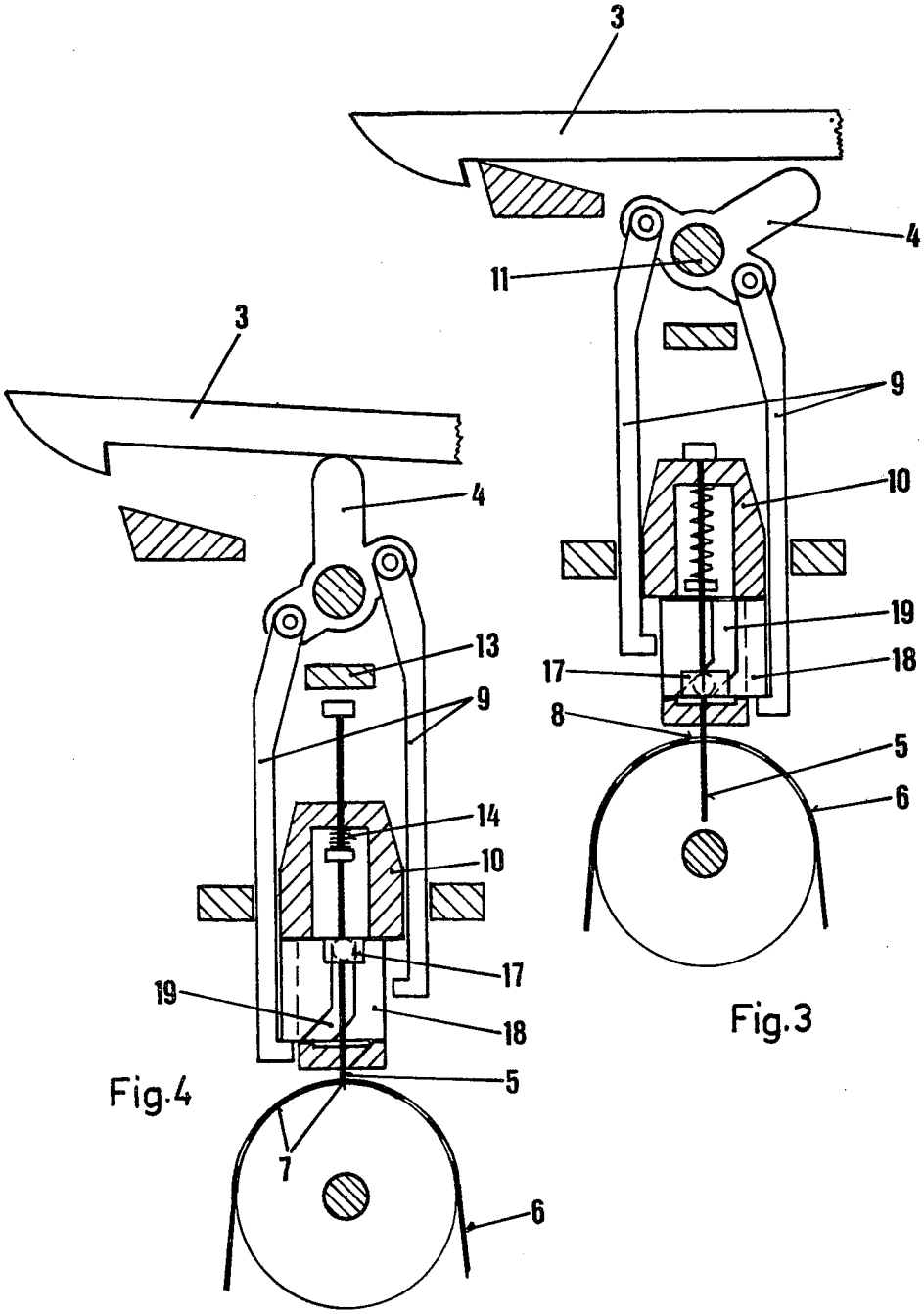
FIG. 3 is a fragmentary sectional view corresponding to FIG. 1, after the reading needle has read a hole in the pattern card.
FIG. 4 is a fragmentary sectional view corresponding to FIG. 1, after the reading needle has read a nonperforated part of the pattern card.

Referring to FIG. 4, the operation will be discussed during engagement of the reading needle 5 with a nonperforated part 7 on the pattern card 6. The bar 10 is again lowered and the reading needle is held back by the nonperforated part of the card. The pressure which is thereby applied on the pattern card corresponds to the tension existing in the spring 14. Since, however, the bar 10 with the lock member 18 is lowered farther with respect to the movement of the reading needle, the groove 19 slides over the cam follower on the guide block 17. Due to the inclined arrangement of the groove 19, the lock member 18 is moved to the left. It slides over the bar 10 and carries therewith during the further movement of the bar 10 over the offset portion the left draw arm 9. The cam follower 17 slides thereby in the vertical part of the groove 19. The correcting element 4 simultaneously tilts into the FIG. 4 position, in which it liftingly supports the draw hook 3 out of engagement with the draw knife.

The tiltable correcting element 4 remains in its FIG. 4 position until it is again adjusted through a pull on one of the draw arms 9. The correcting element 4 is to be viewed as a self-locking member which remains in a position which has once been assumed. It can be secured in addition by not shown stops, notches, springs, brakes and the like against unintended pivotal movement.

During each movement of the power-amplifying bar 10 toward the pattern card 6, the lock member 18 is in the area of the offset portion of one of the draw arms 9 and a control or an operation occurs to change the position of the draw arms. These draw arms are operated frictionally from the bar 10 and without greater forces occurring at the reading needle. Thus the bar 10 carries out two engaging movements, namely first the reading movement— control period—, during which the reading needle 5 is lowered onto the pattern card 6 and the lock member 18 is moved forwardly laterally over the bar, and the operating movement—operating period—during which the draw hook 3 or a different member of a dobby or weaving machine is adjusted.

In the described exemplary embodiment, the draw hook 3 follows the correcting element 4 under the influence of gravity and/or a spring force. This may lead to undesired delays in fast-running machines.

In the exemplary embodiment according to FIGS. 1 to 4, it is possible to leave out the spring 14 and the flange 15 and to replace them by a stationary stop 13. After the device corresponding to FIG. 4 has read a nonperforated part, the bar 10 moves back to its initial position. The reading needle 5 engages with its head on the stop 13 and causes it to be moved back in the bar into the position according to FIG. 1. Thus an automatic or forced return of the reading needle occurs.

Figure 5:
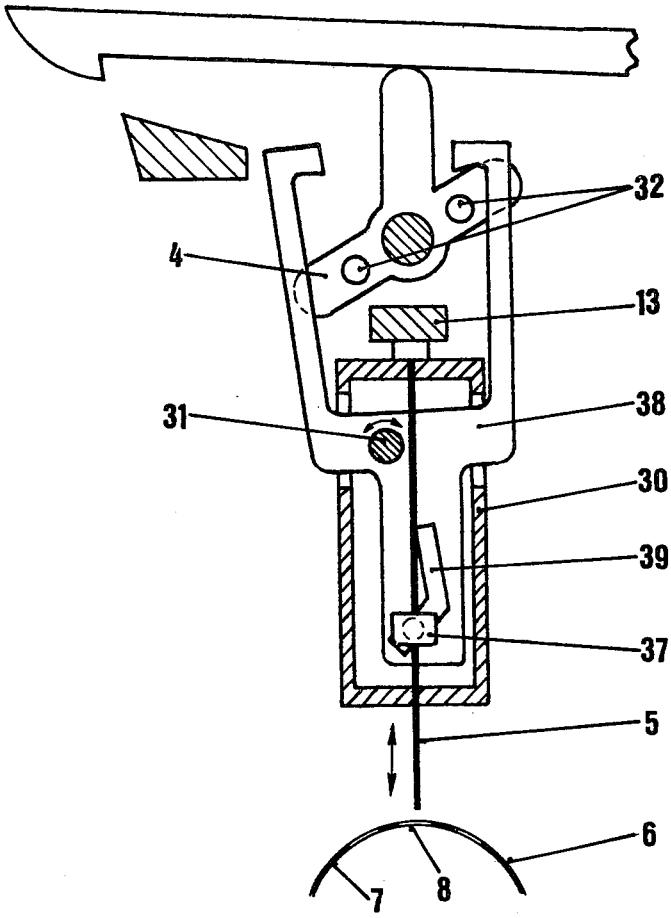
FIG. 5 is a fragmentary sectional view of a shed-forming machine corresponding to FIGS. 1, 3 and 4 having a modified control device embodied therein.

A modification of the examples discussed so far is illustrated in FIG. 5.

As a most important change, it must be remarked that the lock member 38 no longer carries out a linear transverse movement with respect to the direction of movement of the power-amplifying bar 30 but it carries out a swiveling or pivoting motion about the axis of the shaft 31. Furthermore, the draw arms are a part of the lock member, and the offset ends act as carriers for pins 32 of the correcting element 4.

The operation of the embodiment of FIG. 5 is the same as for FIGS. 1 to 4. The bar 30 moves frictionally toward the pattern card 6 wherein the reading needle 5 penetrates either a hole 8 or, in the case of a nonperforated part 7, is moved or shifted back in the bar. Depending on the position of the needle, the cam follower 37 moves to the one or other end of the groove 39, which causes the lock member 38 to be swung so that one or the other offset portion of the arms 9 causes, through movement of the bar, the correcting element 4 to tilt.

Figure 6:
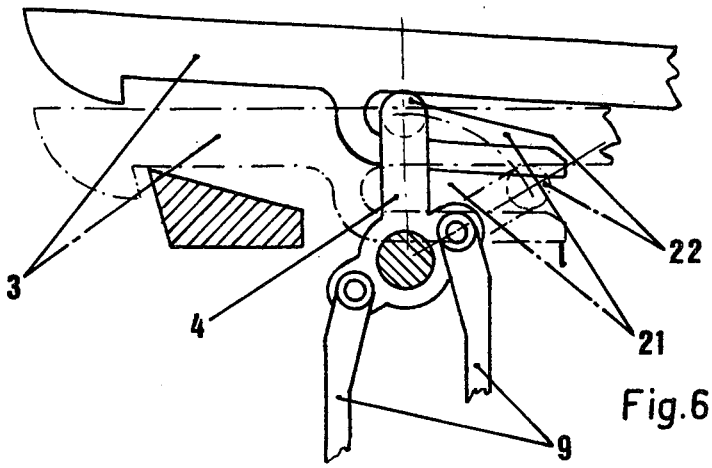
FIG. 6 illustrates a modified correcting element.

FIG. 6 illustrates an embodiment in which the draw hook 3 is actively carried along by the correcting element 4. For this purpose, the draw hook has an open slot 21 on the underside thereof and which is spaced from the hook, into which slot engages a cam 22 on the correcting element. The slot 21 extends approximately parallel to the longitudinal axis of the draw hook 3 and is sufficiently long so that the cam 22, in both positions of the correcting element 4, securely engages it. This arrangement permits the control movement of the draw hook through the draw arms 9 to occur simultaneously and frictionally with the movement of the bar 30.

Since the reading needle 5 and the lock members 18,38 are made of light weight material and construction, and only a small restoring force in the spring 14 or no spring at all is required, high control sequences, speeds and thus high rotational speeds can be achieved with the shed-forming machine without the pattern card material being excessively stressed. Because the reading-in operation, together with transmitting the result to the draw hooks, requires neither springs nor free fall or gravity as an aid, an extraordinary secure function of the machine is achieved.

Figure 7:
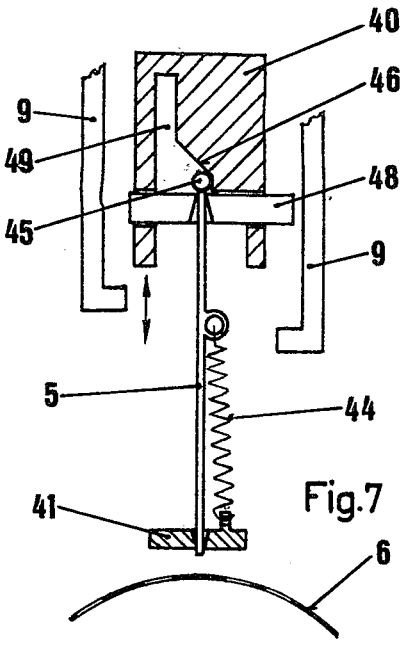
FIG. 7 illustrates a further modification of the control device with the reading needle and the lock in the normal position.
Figure 8:
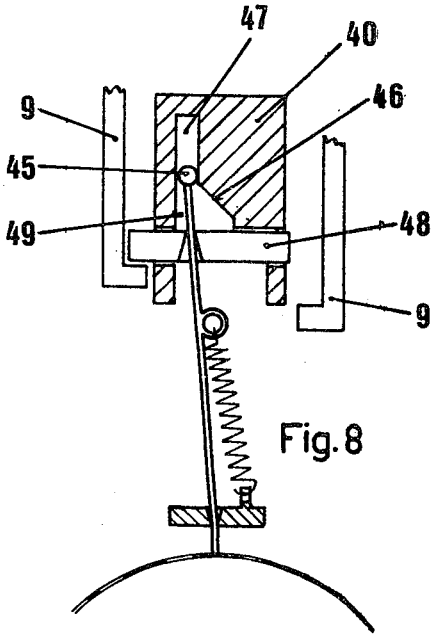
FIG. 8 illustrates the same embodiment during reading of a nonperforated part of the pattern card.

FIGS. 7 and 8 show two positions of the most important portion of a further modified embodiment. This portion is to be substituted for the corresponding portion of the embodiment of FIGS. 1 to 4. Reference numeral 40 identifies the power-amplifying bar having a transversely movable lock member 48 in which the reading needle 5 is suspended. The reading needle 5, which is guided in the stationary guide member 41, is pulled toward the pattern card 6 by the spring 44 secured to and extending therebetween.

If the bar 40 is lowered and the needle does not find a hole, then it rests on the nonperforated part 7 of the pattern card and its head 45 slides into an enlarged portion of a cavity 49 in the bar. The cavity 49 has a sloped ramp surface 46 and a recess 47 which extends approximately parallel to the direction of movement of the bar 40. When the head 45 of the needle slides off on the sloped ramp surface 46, the lock member 48 is moved laterally to the left, so that it, according to FIG. 8, projects on the left side over the offset portion of the left draw arm 9. During a further movement of the bar 40, the lock member 48 carries along therewith the left draw arm 9 while the head 45 of the needle penetrates unhindered into the straight recess 47 of the cavity 49.

If, on the other hand, a hole is read, the lock member 48 does not move from its normal position according to FIG. 7 and carries along therewith the right draw arm 9.

During a return movement of the bar 40, assuming a shifting of the lock member 48 and upper head end 45 of the needle, the tension spring 44 which is now arranged inclined with respect to the axis of the reading needle 5 returns the needle and also therewith the lock member 48 into the normal position.

Figure 9:
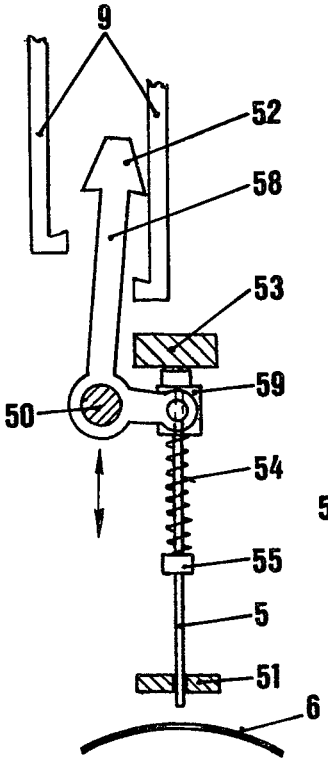
FIG. 9 illustrates a still further modification of the control device in the normal position.
Figure 10:
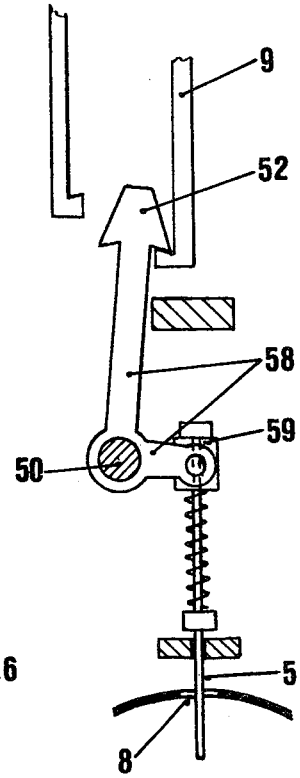
FIG. 10 is similar to FIG. 9 but during reading of a hole.
Figure 11:
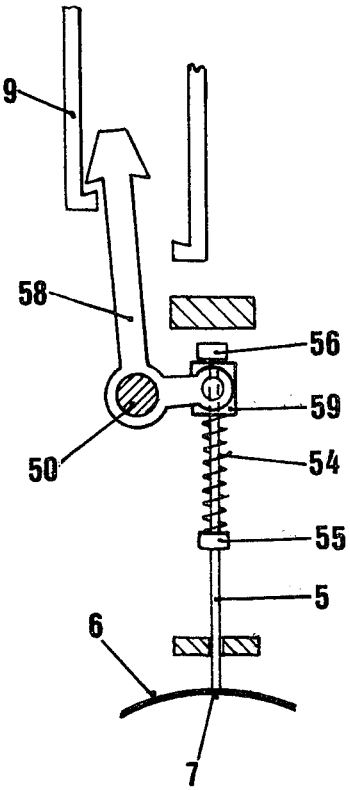
FIG. 11 is similar to FIG. 9 but during reading of a nonperforated part of the pattern card.

FIGS. 9 to 11 illustrate the normal position of the most important portion of a further modified embodiment during a reading of a hole and during a reading of a nonperforated part. This portion is to be substituted for the corresponding portion of the embodiment of FIGS. 1 to 4.

The back and forth moving power-amplifying bar 50 is very large. The power-amplifying bar 50 consists of a shaft the axis of which extends transversely to the pattern card 6 and on which the lock member 58 is pivotally supported. The lock member 58 consists of a two-arm lever, wherein one arm has a sliding guide member 59 thereon for guiding the reading needle 5. The other arm has a double hook portion 52 on the free end thereof. A restoring spring 54 encircles the reading needle and engages at one end the guide member 59. The other end of the spring engages and is limited by the flange 55. Reference numeral 53 identifies a stationary stop which defines the height of lift of the reading needle and with it also the range of pivoting for the lock member 58.

During the movement of the power-amplifying bar 50 toward the pattern card 6, the reading needle is carried along therewith by the sliding guide 59, the spring 54 and the flange 55. The lower end of the needle is guided in the guide member 51. If the needle 5 aligns with a hole 8 of the pattern card (FIG. 10), then the entire unit moves downwardly unchanged. The lock member 58 remains thereby in its normal position, namely with the upper double hook end 52 pivoted to the right so that it takes along therewith right draw arm 9.

In order for the lock member 58 not to carry out a counterclockwise pivoting movement during a plunge of the needle into the pattern card, which pivoting movement is caused from undesirable outside factors, there exists the possibility to hold same at all times under a braking torque with respect to the shaft 50, which braking torque is less than the smallest torque caused by the spring 54.

If the needle 5 is aligned with a nonperforated part 7 of the pattern card (FIG. 11), then further movement of the reading needle 5 is stopped while the bar 50 contimes to move toward the pattern card 6. The spring 54 urges the sliding guide 59 against the head 56 of the needle. During a further movement of the bar 50, the lock member 58 swings to the left and a large exertion of power is not required for this pivotal movement. The double hook end 52 takes along therewith the left draw arm 9 and the sliding guide 59 effects a compressing of the spring 54 on the needle since the needle remains stationary.

FIGS. 12 to 17 illustrate, as the most important portion of an exemplary device, the movable, power-amplifying, wave-shaped bar 60, on which the lock member 68 is pivotally supported. This portion is to be substituted for the corresponding portion of the embodiment of FIGS. 1 to 4. The reading needle 5 is elastically flexibly, secured on the lock member 68 and is directed toward the pattern card 6. A stationary wedge 67 having a ramp surface 69 thereon is arranged between the draw arms 9 and serves at the same time as a part of a guideway 900 for the draw arms. The lock member 68 has a double hook head end 62. A characteristic of this embodiment is that the reading needle 5 is not positioned directly vertically above the pattern card 6 or aligned with a vertical axis through the card cylinder but is, instead, and during reading, inclined at an angle with respect to the surface of the pattern card.

Figure 12:
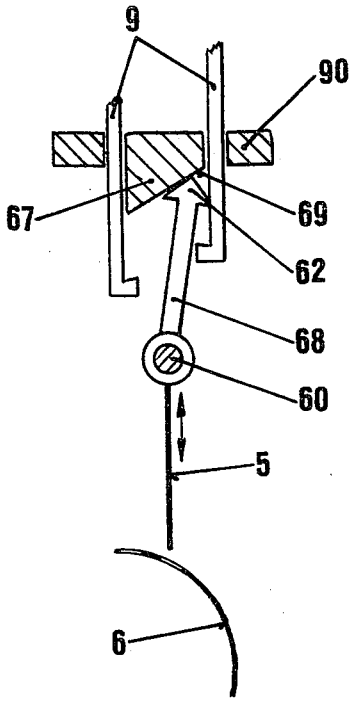
FIGS. 12 to 14 illustrate a still further modification of the control device in the normal position and during the reading of a hole.
Figure 13:
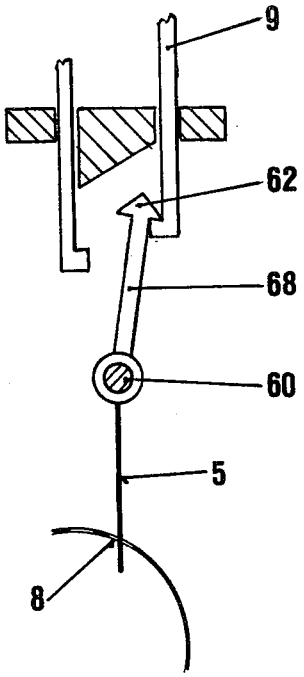

FIG. 12 illustrates a normal position. The power amplifier or bar 60 is moved sufficiently far upwardly that the head 62 of the lock member 68 is guided to the right by the ramp surface 69. The hook-shaped end 62 is positioned above the offset portion of the right draw arm 9.

Figure 14:
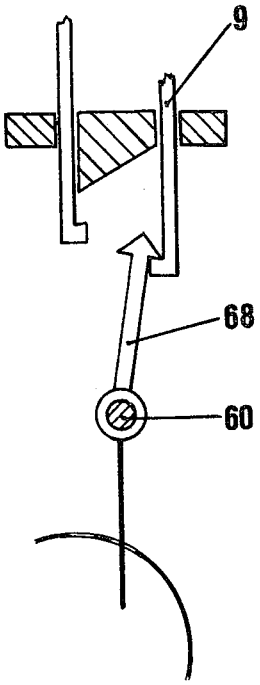
Figure 15:
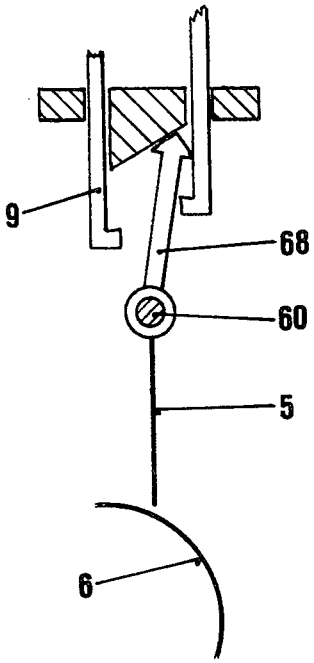
FIGS. 15 to 17 illustrate the same embodiment in the normal position and during the reading of a nonperforated part of the pattern card.

If the bar 60 is now lowered toward the pattern card 6 and the reading needle 5 is aligned with a hole 8 (FIG. 13), the lock member 68 remains under the action of a not shown, weak brake in the normal position and takes along therewith the right draw arm 9 during a further lowering of the bar 60 (FIG. 14).

Figure 16:
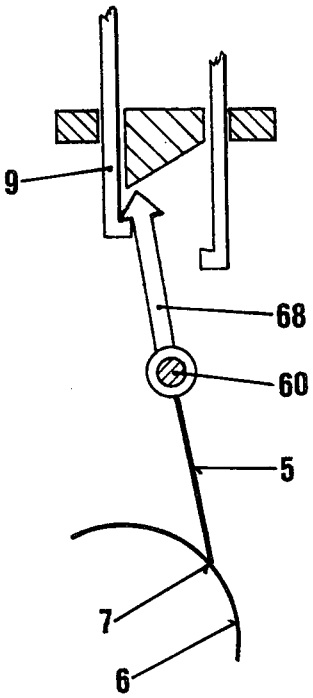
Figure 17:
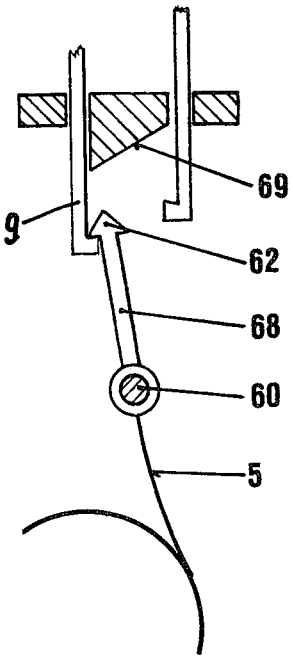

If now, however, the reading needle 5 is aligned with, during lowering of the bar 60 from the normal position (FIG. 15), a nonperforated part 7 (FIG. 16), then the needle slides off to the right due to the nonperpendicular angle of incidence relative to the pattern card. The lock member 68, which is secured on the reading needle 5 pivots, as shown in FIG. 16 and its head end 62 engages the offset portion of the left draw arm 9 so that it takes along therewith the said draw arm during the further movement of the bar. The needle continues thereby to slide off on the pattern card and is slightly bent because it is elastically constructed (FIG. 17). The needle 5 is again extended during the return movement of the bar 60, and the head end 62 of the lock is again returned into the normal position by the ramp surface 69.

Differing from the so far described examples, where the head of the reading needle releases the controlling movement of the lock member, this movement is released in the example according to FIGS. 18 to 21 by the tip of the reading needle 5. This portion is to be substituted for the corresponding portion of the embodiment of FIGS. 1 to 4. A first member 700 of the power amplifier or bar is located on one side of the pattern card and a second member 70 of the power amplifier or bar with the lock member 78 is located on the other side thereof. The reading needle has an enlarged head 76 and a fixed collar 75 thereon for supporting the restoring spring 74. The spring 74 is engaged with and extends between the collar 75 and the first part 700. The lock member 78 is slidingly supported transversely with respect to the direction of movement of the bar 70,700 and has a cavity 79 therein with a sloped ramp surface 77. The pattern card 6 slides within a fixed guideway 71.

Figure 18:
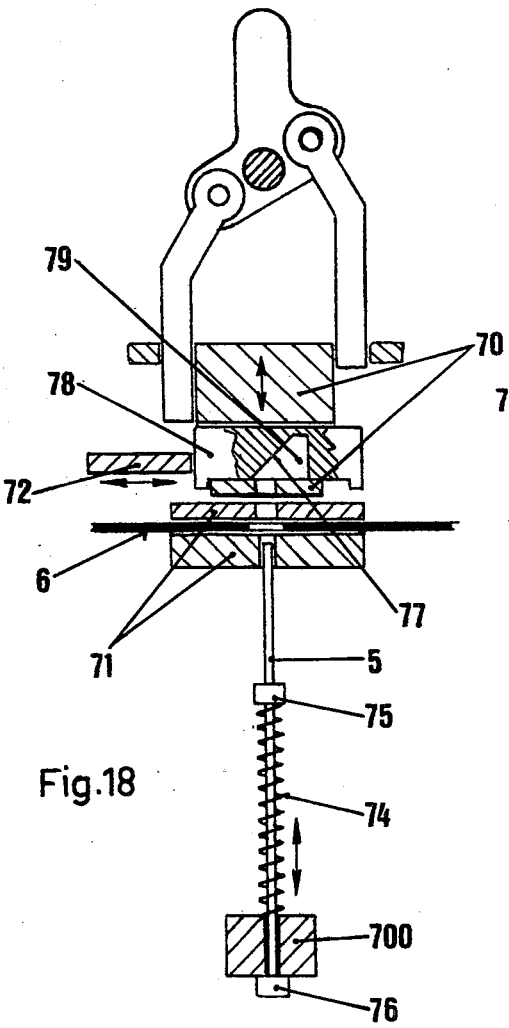
FIG. 18 illustrates a still further modification of the control device in the normal position.
Figure 19:
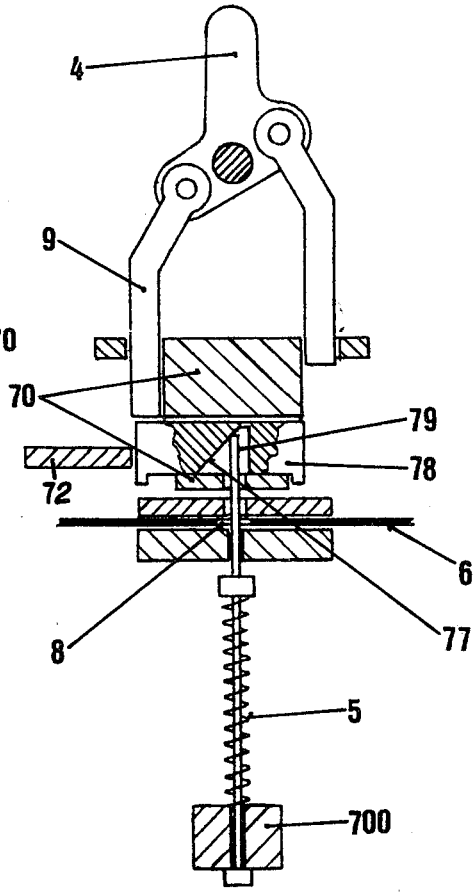

FIG. 18 illustrates the normal position wherein the lock member 78 is pressed to the right by a slide 72 which can be driven by any convenient means sequentially timed with the drive shaft 26 (FIG. 2). For example, everytime during a cycle of rotation of the drive shaft, the slide 72 has been moved to the left, a cam surface (not illustrated) will engage the slide and push it to the right. Otherwise, the cam surface will miss the slide if it is not displaced to the left. The two members 70,700 of the bar now move one after the other. First the member 700, which carries the reading needle 5, moves toward the pattern card 6. If the needle 5 aligns with, according to FIG. 19, a hole 8, then its position relative to the moved bar member 700 remains unchanged. The tip of the needle moves into the cavity 79 of the lock member 78 and moves the lock member 78 to the left during its sliding on the ramp surface 77. After this, the other member 70 of the bar carries out its frictional movement in the same direction as the first bar member 700 which causes the left arm 9 of the device to be pushed upwardly and the correcting element 4 carries out the tilting movement and one obtains the position according to FIG. 20. During the movement of the partial bar 70, the reading needle can synchronously follow the bar member 70, or can remain in the illustrated position or after reaching the illustrated position may return right away again into the initial position under the action of the bar member 700.

FIG. 21 illustrates the operation of the same device from the normal position of FIG. 18 wherein the reading needle is aligned with a nonperforated part 7 of the pattern card. The needle 5 cannot influence the position of the lock member 78 and the lock member takes along therewith the right arm 9 of the correcting element 4 during the movement of the bar member 70.

Because a nonperforated part in the card was already present in the preceding reading, the lock member 78 will only drive up to the hit right arm 9 and acknowledges its position.

In the modified embodiment according to FIGS. 22 and 23, the reading needle is replaced by an air or fluid jet 5'. This portion is to be substituted for the corresponding portion of the embodiment of FIGS. 1 to 4. The opening 5A in the lower guideway 81 functions as a nozzle for the jet 5'. The upper, power-amplifying bar 80 with the lock member 88, the slide 82, the arms 9 and the correcting element 4 is constructed the same as in the aforedescribed example of FIGS. 18 to 21. In addition, the pattern card 6 slides within a guideway 8. The cavity 89 in the lock member does not have a sloped ramp surface but, instead, a baffle 87.

FIG. 22 illustrates the normal position. If the pattern card 6 has a hole 8 therein, then the jet 5' first enters into the left part of the chamberlike cavity 89 where a backwash is created and to balance same, the lock member is pressed to the left. One obtains the position according to FIG. 23 in which the lock member 88 takes along therewith the left arm 9 during an upward movement of the partial bar 80. In order to again take on the normal position, the slide 82 presses the lock 88 again to the right wherein the air in the left chamber of the cavity 89 passes slowly over the baffle 87 into the right chamber and from there through the channel 84 to the outside. If a nonperforated part of the pattern card is in the area of the jet 5', then the lock member 88, which is in the normal position, remains uninfluenced. It takes along the right arm 9 therewith.

Figure 24:
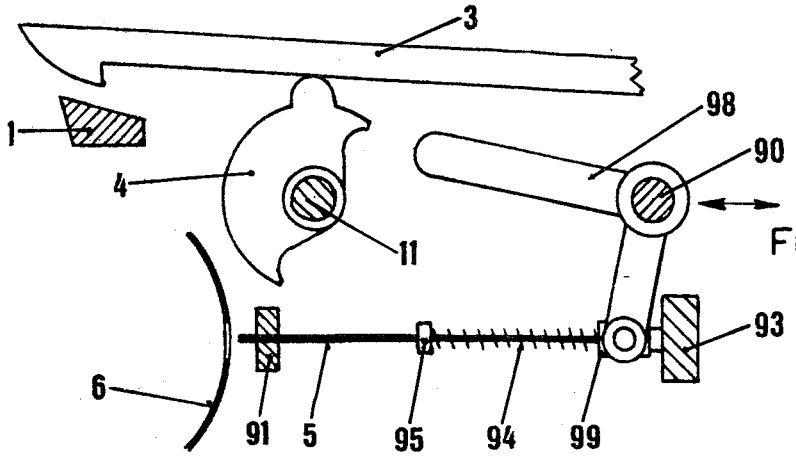
FIG. 24 illustrates a still further modification in the normal position.
Figure 25:
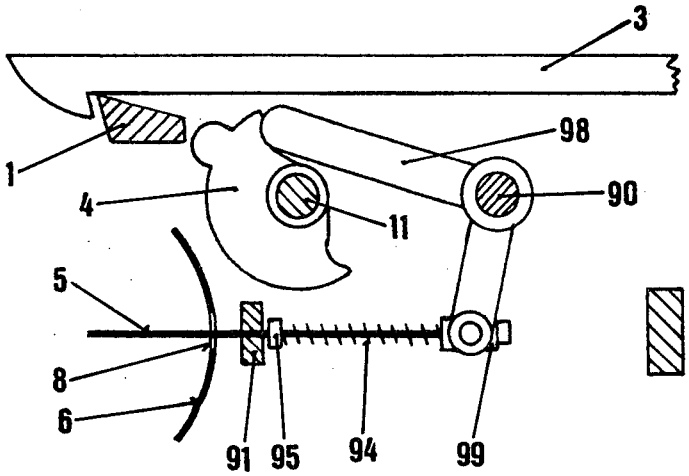
FIG. 25 is similar to FIG. 24 but during a reading of a hole.
Figure 26:
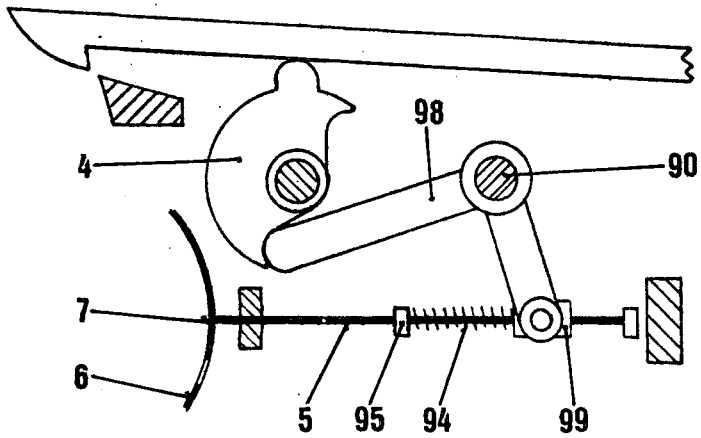
FIG. 26 is similar to FIG. 25 but during a reading of a nonperforated part of the pattern card.

FIGS. 24 to 26 illustrate a further modified embodiment in which the draw arms have been left out and the lock member 98 acts directly onto the correcting element 4. This portion is to be substituted for the corresponding portion of the embodiment of FIGS. 1 to 4. The power-amplifying bar 90 is here gain constructed as a shaft having a double-arm lock 98 pivotally positioned thereon. One arm has at its end a sliding guide 99 for the reading needle 5. The restoring spring 94 encircles the reading needle and engages at one end the sliding guide 99 and at the other end a collar 95 fixed thereto. Reference numeral 91 identifies a guide member for the reading needle and reference numeral 93 identifies a stationary stop which defines the height of lift of the reading needle 5 and therewith also the range of pivoting for the lock member 98.

Starting out from the position illustrated in FIG. 24, in which the draw hook 3 of the shed-forming machine is held in the raised position by the correcting element 4, the bar 90 and thus also the lock member 98 move toward the pattern card 6 to read the next insertion of a pick. The reading needle 5 is taken along by the sliding guide 99, the spring 94 and the collar 95. If the reading needle is aligned with a hole 8 (FIG. 25), then the position of the lock member remains unchanged so that the longer arm of the lock member 98 engages the upper recess of the correcting element 4 and tilts same about the axis of the shaft 11. The draw hook 3 is lowered for engagement with the draw knife 1. After returning the bar 90 to the right, the correcting element 4 remains in the assumed position, until it is again changed over by the lock member during a change of the fabric binding.

FIG. 26 illustrates the operation of the device in the case where the reading needle 5 is aligned with a nonperforated part 7 of the pattern card 6. The height of lift of the needle is limited, while the bar 90 continues to move with the lock member 98 and compresses the spring 94. This causes the shorter arm of the lock member to be held back and be pivoted about the axis of the bar 90 so that the longer arm will contact the lower recess of the correcting element 4 which releases the tilting thereof. The spring 94 is dimensioned such that it is stronger than the braking action resisting the pivoting of the lock member 98 on the bar 90 and is weaker than the strength characteristic of the pattern card resisting piercing.

In all illustrated exemplary embodiments, it is possible while the draw knife 1 is in the normal position, for the reading-in operation of the reading needle 5 to take place twice in order to read in the known manner first the old and then the new weft on the card to thus assure the weft-logic operation of the dobby.

After the reading needle is lifted off from the pattern card, the needle and the lock member can be moved laterally in order to read in the pattern card, the next longitudinal line for the following weft, to thus control the draw hook which is hinged to the other end of the not shown baulk. It is also possible for two side-by-side arranged lock members to act onto one correcting element, whereby each lock is supported on a separate bar.

In the described embodiments, the reading needles are without exception moved toward the pattern card in order to read the card and to control the lock member in the same operation. However, it is also possible to press the pattern card against the reading needles.

As already described the power amplifiers 10, 30, 40, 50, 60, 70, 700, 80, 90 carry out a movement toward and away from the pattern card 6.

An embodiment of the structure by which the power amplifier 10 is raised and lowered is shown in FIG. 2. A tongue 24 is in connection with a crank arm 25 which is supported eccentrically on a drive shaft 25. During each whole rotation of the drive shaft 25 a control place 8 or 7 of the pattern card 6 is read and the draw hook 3 is controlled by the correcting element 4.

In order to secure that the correcting element 4 does not make an unintended pivotal movement it is controlled by a friction brake which consists—as shown in FIGS. 1 and 2—of a laminated spring 28 fixed on the stationary block 29 and pressing the hub 27.

The power amplifiers 30 (FIG. 5), 40 (FIGS. 7 and 8), 50 (FIGS. 9 to 11), 60 (FIGS. 12 to 17) and 90 (FIGS. 24 to 26) are drivable using the aforedescribed structure which drives the power amplifier 10. The power amplifier of FIGS. 18 to 21 is comprised of two parts, a first part 70 and a second part 700. In this embodiment, an additional crank arm (not illustrated) is secured at one end to the drive shaft 26 and is secured at the other end to the part 700. The not illustrated crank arm will necessarily be angularly spaced from the drive shaft 26 so that the part 700 will precede the part 70 toward the pattern card 6. The same type of control can be utilized for the embodiment of FIGS. 22 and 23 as is used for the power amplifier 10. The part 80 will be driven toward and away from the pattern card 6.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a method for operating a reading device of a control machine comprising a reading means which reads a patternlike perforated, foillike pattern card and a power amplifier means which acts in direction of the movement of said reading means, from which a draw hook movable between limit positions is controlled, the improvement comprising wherein said reading means is supported in at least one part of the power amplifier means and is moved therewith, and wherein a lock member is movably supported on said power amplifier means, said lock member being moved into a position transversely with respect to the direction of movement of said power amplifier means by said reading means reading said pattern card for a perforated part or a nonperforated part, both read conditions are power-amplified and are forwarded automatically in to simultaneously effect a tilting of a correcting element, said correcting element remaining tilted in the same position until a different condition is read on said pattern card so that depending on the read pattern part said correcting element, during a movement of said power amplifier means, effects a simultaneous movement of said draw hook between the limit positions thereof.

2. In a reading device of a control machine, comprising a pair of operating arms, a pattern card having a plurality of reading places with at least one of a nonperforated part and a hole per reading place, a reading means for reading said pattern card, and power amplifier means which acts in direction of the movement of said reading means, the improvement comprising wherein said means is movably supported relative to said power amplifier means in a direction toward and away from said pattern card, a lock member movably mounted on said power amplifier means and movable therewith in a direction transverse of the direction of movement of said reading means between first and second positions, a pivotally supported correcting element supported separate from said power amplifier means, said correcting element having means thereon defining a pair of operating arms, a draw hook movable between first and second positions in response to a pivotal movement of said correcting element wherein said lock member engages in both of said first and second positions one of said operating arms when said power amplifier means is moved relative to said correcting element to effect a pivoting of said correcting element and the simultaneous movement of said draw hook between said first and second positions.

3. The improved device according to claim 2, wherein said lock member is linearly slidably supported on said power amplifier means.

4. The improved device according to claim 3, wherein said reading means includes an elongated needle and wherein said lock member has a groove therein having a first segment which extends in a direction parallel to the longitudinal axis of said needle and a second segment sloped toward a terminal end of said needle, a cam follower secured to said needle and slidably disposed in said groove, and wherein each one of said pair of operating arms is pivotally secured to said correcting element and has offset ends which latch onto said lock member in said first and second positions.

5. The improved device according to claim 3, wherein said reading means includes an elongated reading needle, wherein said power amplifier means includes first and second parts, wherein said lock member is slidably supported in said first part and said reading needle is slidably supported in said second part, said lock member having a cavity therein with a sloped ramp surface, said cavity opening toward the end of said reading needle, said end of said reading needle being pushed through said perforations in said pattern card to engage said ramp surface and simultaneously effect a lateral movement of said lock member while said end slides on said ramp surface.

6. The improved device according to claim 5, wherein said first and second parts of said power amplifier means are movable frictionally one after the other.

7. The improved device according to claim 2, wherein said lock member is pivotally supported on said power amplifier means.

8. The improved device according to claim 7, wherein said reading means includes an elongated needle, wherein said lock member is constructed as a multiple arm rocking lever which is pivotally supported on said power amplifier means, wherein one lever arm on one side of said pivotal support has an angled groove therein, a cam follower secured to said needle and slidably disposed in said groove, wherein a pair of lever arms are provided on the opposite side of said pivotal support, the ends of each of said pair of lever arms being movable in response to a change in the relative position of said cam follower in said groove to engage one of said operating arms.

9. The improved device according to claim 7, wherein said reading means includes an elongated needle and wherein said lock member is constructed as a two-arm rocking lever which is pivotally supported on said power amplifier means, wherein one lever arm of said rocking lever is slidably connected to said needle, guide means for said needle located adjacent said pattern card, a spring connected to and extending between said needle and said guide means and hook means on the end of the other lever arm operatively connected to one of said operating arms.

10. The improved device according to claim 9, wherein said hook means has two lateral projections, which during the pivoting movement of said lock member become operatively connected to one of said operating arms.

11. The improved device according to claim 2, in a shed-forming machine, of the Hattersley system having draw knives, said draw hooks being engageable with said draw knives, wherein said correcting element is constructed as a three-arm rocking lever, one arm of said rocking lever being engaged with said draw hook to lift said draw hook off from said draw knife.

12. In a reading device of a control machine, comprising a pattern card having a plurality of reading places with at least one of a nonperforated part and a hole per reading place, a reading means for reading said pattern card, and a power amplifier means which acts in direction of the movement of said reading means, the improvement comprising wherein said reading means is movably supported relative to said power amplifier means in a direction toward and away from said pattern card, a lock member movably mounted on said power amplifier means and movable therewith in a direction transverse of the direction of movement of said reading means between first and second positions, a pivotally supported correcting element supported separate from said power amplifier means and having means thereon defining a pair of operating arms, a draw hook movable between first and second positions in response to a pivotal movement of said correcting element, wherein said lock member engages in both of said first and second positions thereof one of said operating arms when said power amplifier means is moved toward said pattern card and relative to said correcting element to effect during said movement of said power amplifier means toward said pattern card a pivoting of said correcting element and the simultaneous movement of said draw hook between said first and second positions thereof.

* * * * *